US007181847B2

(12) United States Patent
Schneider et al.

(10) Patent No.: US 7,181,847 B2
(45) Date of Patent: Feb. 27, 2007

(54) PROCESS FOR MANUFACTURING A CYLINDRICAL HOLLOW BODY AND HOLLOW BODY MADE THEREBY

(75) Inventors: Reinhold Schneider, Leoben (AT); Gerhard Lichtenegger, Kapfenberg (AT); Günter Schirninger, Kindberg-Aumühl (AT)

(73) Assignee: Boehler Edelstahl GmbH & Co. KG, Kapfenberg (AT)

( * ) Notice: Subject to any disclaimer, the term of this patent is extended or adjusted under 35 U.S.C. 154(b) by 745 days.

(21) Appl. No.: 09/983,497

(22) Filed: Oct. 24, 2001

(65) Prior Publication Data

US 2002/0104213 A1 Aug. 8, 2002

(30) Foreign Application Priority Data

Oct. 24, 2000 (AT) ..... 1822/2000

(51) Int. Cl.
*B21D 53/10* (2006.01)
*B21C 37/06* (2006.01)

(52) U.S. Cl. ..... 29/898.066; 29/898.14; 29/33 T; 72/254; 72/368; 420/65; 420/66

(58) Field of Classification Search ..... 29/889.7, 29/898.066, 890.053, 898.14, 335, 417; 420/65, 420/66; 72/253.1, 254, 256, 267, 368
See application file for complete search history.

(56) References Cited

U.S. PATENT DOCUMENTS

| | | | | | |
|---|---|---|---|---|---|
| 1,472,922 | A | * | 11/1923 | Lothrop | |
| 1,664,990 | A | * | 4/1928 | Oehmig, Jr. et al. | 72/255 |
| 1,840,472 | A | * | 1/1932 | Singer | 72/263 |
| 1,859,707 | A | * | 5/1932 | Leighton | 72/255 |
| 2,026,979 | A | * | 1/1936 | Jones | 72/256 |
| 2,648,602 | A | * | 8/1953 | Payson et al. | |
| 2,713,941 | A | * | 7/1955 | Schuler | |
| 2,896,783 | A | * | 7/1959 | Swanson | 72/255 |
| 2,903,130 | A | * | 9/1959 | Reichl | 72/260 |
| 3,199,324 | A | * | 8/1965 | Marti | |
| 3,229,353 | A | * | 1/1966 | Morrison | 29/898.066 |
| 3,366,472 | A | * | 1/1968 | Tanczyn et al. | |
| 3,387,967 | A | * | 6/1968 | Perry et al. | 75/10.23 |
| 3,528,271 | A | * | 9/1970 | Ponio | |
| 3,574,601 | A | * | 4/1971 | Myers et al. | 420/38 |
| 3,772,005 | A | * | 11/1973 | deBarbadillo, II | |
| 3,927,450 | A | * | 12/1975 | Sommer et al. | |
| 4,043,023 | A | * | 8/1977 | Lombard | |
| 4,126,064 | A | * | 11/1978 | Tarrant | 82/1.11 |
| 4,421,571 | A | | 12/1983 | Kudo et al. | |
| 5,049,210 | A | * | 9/1991 | Miyasaka et al. | 428/586 |
| 5,268,142 | A | | 12/1993 | Hasegawa et al. | |
| 5,939,018 | A | * | 8/1999 | Ohtsubo et al. | 420/34 |
| 5,944,921 | A | * | 8/1999 | Cumino et al. | 148/325 |
| 6,210,806 | B1 | | 4/2001 | Hidaka et al. | |
| 6,502,486 | B1 | | 1/2003 | Tenbrack et al. | |
| 6,691,397 | B2 | * | 2/2004 | Chakravarti | 29/527.1 |
| 2004/0109784 | A1 | * | 6/2004 | Arbab et al. | 420/37 |

FOREIGN PATENT DOCUMENTS

| | | | |
|---|---|---|---|
| DE | 19520833 | | 12/1995 |
| DE | 19734563 | | 12/1998 |
| EP | 0511647 | | 11/1992 |
| EP | 0638658 | | 2/1995 |
| EP | 0937782 | | 8/1999 |
| EP | 0 995 806 | * | 4/2000 |
| FR | 2566429 | | 12/1985 |
| JP | 04-224659 | * | 8/1992 |
| JP | 05-007921 | * | 1/1993 |
| JP | 09-310121 | * | 12/1997 |
| JP | 2000-290756 | * | 10/2000 |
| WO | 99/07495 | | 2/1999 |

OTHER PUBLICATIONS

SteelWorks. American Iron and Steel Institute. Steel Glossary, http://www.steel.org/learning/glossary/glossary.htm.*
Karl-Heinz Brensing & Baulur Somer. Steel Tube and Pipe Manufacturing Processes. [available] www.mrw.de/downloads/stahlrohre_engl.pdf.*
English Language translation of "Stahlrohr Handbuch" US Patent Office.*
Derwent English Abstract EP 0638658.*
M. Nayyar, et al., Piping Handbook (7th ed). McGraw-Hill: 2000. p. A.243-A.255.*
DMV Product Range Brochure, Jun. 6, 2000. available at: http://www.dmv-stainless.com/downloads/DMV_Product_Range.pdf (visited Jul. 11, 2005.*

(Continued)

*Primary Examiner*—Eric Compton
(74) *Attorney, Agent, or Firm*—Greenblum & Bernstein, P.L.C.

(57) ABSTRACT

Process for manufacturing cylindrical hollow bodies with a circular cross-section using solid rough material of corrosion-resistant, martensitic chromium steels. A remelting block is produced and a tube blank is made therefrom, the tube blank being formed into a tube at hot forming temperature by extrusion at a deformation ratio of at least 6. Hollow bodies are cut from the resultant tube.

21 Claims, No Drawings

OTHER PUBLICATIONS

Sumitomo Pipe Making Brochure (dated unknown). available at: http://www.sumitomometals.co.jp/e/business/sm-series.pdf (visited Jul. 11, 2005).*

JPO Machine Translation of JP 2000-290756.*

Stahlrohr Handbuch (Steel Tube Manual), 9th Edition, Vulkan—Verlag 1981, ISBN 3-8027-2655-3, pp. 132 and 133, chapter 2.6 Tube Extrusion Process, with English translation.

Front page and English language claims of European Patent Specification EP 0 764 063 B1.

Front page of PCT application WO 95/34387.

Front page of PCT application WO 99/07495.

English Language Abstract of EP 0638658.

English Language Abstract of FR 2566429.

* cited by examiner

PROCESS FOR MANUFACTURING A CYLINDRICAL HOLLOW BODY AND HOLLOW BODY MADE THEREBY

CROSS-REFERENCE TO RELATED APPLICATIONS

The present application claims priority under 35 U.S.C. § 119 of Austrian Patent Application No. 1822/2000, filed on Oct. 24, 2000, the disclosure of which is expressly incorporated by reference herein in its entirety.

BACKGROUND OF THE INVENTION

1. Field of the Invention

The invention relates to a process for manufacturing cylindrical hollow bodies with a circular cross section using solid rough material made of corrosion-resistant martensitic chromium steel, particularly rings to be subjected to high mechanical stress at least at sections of the cylinder zones near the surface. The invention also relates to the hollow bodies made by this process.

2. Discussion of Background Information

Ring-shaped machine and tool components, such as circular shear blades, roller bearing rings and so forth, may be subject to high mechanical stresses at the cylinder zones near the surface. A high load capacity for surface pressure, high wear resistance, a good level of toughness and high shearing strength of the material are all required in the component regardless of the direction. For special areas of application, in addition to the mechanical properties, the resistance of the material to corrosion is also very important. This property profile can be achieved synergetically by means of alloying techniques.

Tubes can be produced by various processes as rough material for cylindrical hollow bodies or rings, which have a high mechanical load-bearing capacity in all directions at the cylinder surfaces and/or at the adjoining edges. The choice of a specific manufacturing process depends on its applicability for the material, the required product characteristics and/or its economic efficiency.

The highest material quality in highly alloyed rings or hollow bodies made of tubes, can be achieved when a casting or rough material block is formed by forging or rolling while reducing the cross-section by hot forming all round essentially perpendicular to its axis, thus stretching it lengthwise into a round bar. Next, a tubular bar is formed by turning the center or drilling, particularly deep hole boring, from which bar the rings are cut. In the warm forming process an intensive kneading of the material (alloy) occurs, making it possible to produce a material with isotropic characteristics. It also is possible to rough-work individual hollow bodies out of a forged or rolled steel rod, preferably by automatic turning or drilling, whereby, if necessary, center segregation spots can also be machined off. Hollow bodies produced by this method have a particularly high material quality. However, the manufacturing costs are high, the production process is complicated and the cutting waste is considerable.

The use of rolled tubes as the base material for the production of inner or outer rings for roller bearings is known. DE-A-19520833, for instance, shows a process by which is produced basically a continuous casting material of hypereutectoid chromium steel with a high degree of purity, fine carbide precipitations and a highly fine-grained microstructure and wherein the length for use is heated to forming temperature in the as-cast state and without heat treatment and fed into a tube production installation, preferably including a piercing press. In the piercing process, a state of stress is built up in the individual lengths to be formed, which shows as high a negative mean strain value as possible while minimizing shearing strain. As known from DE-C-19734563, both the state of strain during piercing to prevent the material from cracking and the establishment of a specific microstructure are important for securing a high quality of the roller bearing rings.

A perforator equipped as a skew-rolling mill, followed by at least one tube rolling mill can also be used to manufacture seamless tubes as starting material for the production of roller bearing rings made of steels customary for this purpose.

The conventional tube manufacturing processes mostly show a high level of economic efficiency, but they have in common the disadvantage that they cannot be used for highly alloyed tool steels, e.g., for corrosion-resistant martensitic chromium steels. In order to be corrosion-resistant, these kinds of steel have chromium contents of more than about 12 percent by weight and, optionally, are alloyed with molybdenum. For achieving the desired mechanical properties of the material upon heat treatment of the alloy, high carbon concentrations must also be provided for.

At forging temperature, highly alloyed heat-treatable steels usually exhibit material characteristics that preclude perforation and tube rolling. Particularly when making and expanding the perforation of employed material by mandrels or similar tools, cracks form in the material as a result of high tensile and shearing stresses, making it impossible to manufacture pipes of the desired quality.

SUMMARY OF THE INVENTION

The present invention provides a process for manufacturing hollow bodies of the kind stated at the outset, through which process high product quality, product safety and high economic efficiency are achieved at the same time.

Furthermore, this invention provides an economical manufacturing process for the production of hollow bodies made of corrosion-resistant martensitic chromium steels.

In one aspect, the present invention provides a process for the manufacture of a cylindrical hollow body with circular cross-section from solid rough material of corrosion-resistant, martensitic chromium steel. In this process, a remelting block of the chromium steel is provided and a tube blank having an axial borehole is made therefrom. The tube blank is shaped into a tube at hot forming temperature by extrusion at a deformation ratio of at least 6 and the hollow body is cut from the tube.

In another aspect of the invention, the remelting block is a pressurized electroslag remelting block. Furthermore, the remelting block may be rod-shaped.

According to yet another aspect of the invention, the axial borehole is made after forming the tube blank. Also, the axial borehole may be provided by metal cutting drilling.

According to the present invention, the deformation ratio is at least 9, in particular, at least 12.

In another aspect of the invention, at least one dimension of the tube is changed before the hollow body is cut.

In still another aspect of the present invention, the chromium steel comprises, in weight percent, 12 to 29 chromium; 0.02 to 5.9 molybdenum; 0.05 to 0.8 carbon (C); 0.05 to 0.8 nitrogen (N); provided that the sum (C+N) is 0.1 to 1.4. The chromium steel may additionally comprise, in weight percent, at least one of 0.3 to 3.0 manganese; 0.01 to 3.0 nickel; and 0.05 to 2.0 vanadium.

For example, the chromium content of the steel may be up to 28.0 weight percent Cr, e.g., 12.1 to 24 weight percent Cr. The molybdenum content of the steel may, for example, range from 0.25 to 5.8 weight percent Mo. The C and N contents of the steel may each range from 0.15 to 0.7 weight percent, with the sum (C+N) preferably ranging from 0.31 to 1.1 weight percent.

In another aspect of the present invention, the chromium steel may comprise, in weight percent, 12.1 to 24 chromium; 0.25 to 5.8 molybdenum; 0.15 to 0.7 carbon; and 0.15 to 0.7 nitrogen; with the sum (C+N) ranging from 0.31 to 1.1. This steel may further comprise, in weight percent, 0.3 to 3.0 manganese; 0.01 to 3.0 nickel; and 0.05 to 2.0 vanadium.

According to a further aspect of the present invention, the chromium steel may comprise 0.1 to 2 weight percent silicon.

In another aspect of the invention, the cylindrical hollow body made by the process of the present invention may be an article selected from circular shear blades, roller bearing rings, ball-bearing races and ring bodies for axial drives and ball spindles.

The present invention also provides, in still another aspect, a process for the manufacture of a cylindrical hollow body with circular cross-section from solid rough material of corrosion-resistant, martensitic chromium steel, wherein a pressurized electroslag remelting block of the chromium steel is provided, which remelting block is made into a tube blank. The tube blank is provided with a central borehole and shaped into a tube at hot divided into hollow bodies by cutting perpendicularly to the longitudinal axis of the tube. In this process, the martensitic chromium steel comprises as essential elements, besides iron, in weight percent, 12.1 to 24 chromium; 0.25 to 5.8 molybdenum; 0.15 to 0.7 carbon; and 0.15 to 0.7 nitrogen, with the sum (C+N) ranging from 0.31 to 1.1. This steel may further comprise, in weight percent, up to 3.0 manganese; up to 3.0 nickel; and up to 2.0 vanadium.

In yet another aspect, the present invention provides a cylindrical hollow body of corrosion-resistant, martensitic chromium steel with circular cross-section, wherein this hollow body is made by one of the above processes.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In a process in accordance with the present invention, a tube blank is manufactured from a remelting block in a first production stage, and in a second production stage the tube blank is shaped into a tube at hot forming temperature by means of extrusion presses at a deformation ratio of at least about 6, preferably at least about 9, more preferably at least about 12, most preferably at least about 13. The deformation ratio may be as high as about 20 or even higher, for example, up to about 30, to about 50, to about 100 etc. The term "deformation ratio " is defined as the area of cross-section before extrusion divided by the area of cross-section after extrusion. The tube blank may optionally be further processed, whereafter hollow bodies are cut from the tube in a third production stage.

A remelting block can be produced largely without segregations over the block length and over its cross-section. Furthermore, due to the process conditions employed, this block is free of coarse non-metallic inclusions, which reduce its quality, and of centric imperfections, and possesses a high degree of hot working properties in all zones, whereby crystallization is characterized by effectively large vertical components of the solidification direction. According to the invention, tube blanks are formed out of this kind of block by dividing it into individual lengths, and despite the high quality of the block center, an axial borehole is preferably made therein by metal cutting drilling. The desired outer diameter of the tube blank can be provided by appropriate manufacture of the block or by, e.g., forging and machining the same. As the next step in the process according to this invention, a tube blank is brought to forming temperature and formed into a seamless tube by extrusion. From a technical point of view, during extrusion, the material is gouged through an annular die. Surprisingly, no crack formation or brinelling with the risk of crack initiation occurs during this operation, even with the highly alloyed, heat-treatable steels used in this invention. Moreover, gouging a material through an annular die results in a paraxial banded structure in the material in all areas of the cross-section of the tube thus formed, which, in the experts' opinion, should lead to premature wearout of the bearing surface, e.g., in the case of roller bearing rings made thereof, these rings being subjected to mainly radial load. Counter to this expert opinion, tests have instead shown improved service times of heavily loaded roller bearings. Unexpectedly, it was also found that after extrusion, the tubes can be processed into tubes with different dimensions substantially without problems or flaws, without faults such as cracks occurring in the cylinder zones near the surface, when an appropriate technology is used.

After the hollow bodies have been taken off the extruded tube and have been finished, they usually are subjected to a finishing heat treatment. It was found that in this case the tendency towards material distortion is reduced, which distortion can cause an increase in required retouching work by grinding.

As set out technically above, the advantages inherent in the process according to this invention lie in particular in the fact that with this process corrosion-resistant, cylindrical hollow bodies with a circular cross-section, in particular, circular shear blades, roller bearing rings and similar parts can be manufactured with unexpectedly improved performance characteristics from martensitic chromium steels in a highly economical way.

The advantages provided by the instant invention are particularly apparent when the remelting block is made of a corrosion-resistant, martensitic steel, which comprises at least about 12, preferably at least about 12.1, more preferably at least about 13 weight percent, and not more than about 29, preferably not more than about 28.0, and more preferably not more than about 24 weight percent chromium; at least about 0.02, preferably at least about 0.1, more preferably at least about 0.25 weight percent, and not more than about 5.9, preferably not more than about 5.8, more preferably not more than about 3 weight percent molybdenum; at least about 0.05, preferably at least about 0.15, and not more than about 0.8, preferably not more than about 0.7 weight percent carbon; at least about 0.05, preferably at least about 0.15, and not more than about 0.8, preferably not more than about 0.7 weight percent nitrogen; provided that the sum (carbon plus nitrogen) is at least about 0.1, preferably at least about 0.31, and not more than about 1.4, preferably not more than about 1.1 weight percent.

The steel may advantageously contain further elements, in particular, manganese in concentrations of preferably at least about 0.3 weight percent, but preferably not more than about 3.0 weight percent; vanadium in concentrations of preferably at least about 0.05 weight percent, but preferably not more than about 2.0 weight percent; and nickel in concentrations of preferably at least about 0.01 weight percent, but preferably not more than about 3.0 weight percent. Moreover, silicon may preferably be present in amounts of at least about 0.1 and not more than about 2.0 weight percent.

Due to the nitrogen content of the steel, a fine microstructure is achieved in the annealed material, which ensures improved hot working properties thereof. Furthermore, the content of carbon plus nitrogen within the given limits in the steel suppresses the formation of a banded structure during extrusion, resulting in largely isotropic mechanical properties of the pressed blank.

If, as may advantageously be provided for, the remelting block is made of steel that is alloyed, in percent by weight, with:

0.3 to 3.0 manganese (Mn)
12.1 to 28.0 chromium (Cr)
0.25 to 5.8 molybdenum (Mo)
0.01 to 3.0 nickel (Ni)
0.05 to 2.0 vanadium (V)
0.15 to 0.7 carbon (C)
0.15 to 0.7 nitrogen (N),
provided that the sum (C+N) ranges from 0.31 to 1.1, particularly high toughness values are achieved in the hardened and tempered material of the hollow body.

Both for an adjustment of high nitrogen concentrations in the steel of up to 0.8 percent by weight, and in order to provide for particular purity regarding non-metallic inclusions, it is advantageous for the remelting block to be made as an elevated pressure electroslag remelting block.

High security against the occurrence of interior cracks in the tube wall is achieved by making the tube blank by metal cutting of a central borehole out of a solid rough material. In the plant, when heading the tube blank and during pressing itself, compressive strains are built up in the radial direction, which prevents the formation of cracks during the shaping process.

It can be helpful for adjusting the hollow body to desired dimensions, if a further shaping of the extruded pipe is carried out during the second stage of production. This makes it possible to adhere precisely to required cross-section measurements of the tube and to thereby ensure low chip losses and similar processing times in manufacturing a hollow body.

By the process of the present invention hollow bodies having a circular-cross section which will be subjected to high mechanical stressing of at least parts of the cylinder zones near the surface can be made, especially for ball-bearing races and ring bodies of axial drives and ball spindles.

Hollow bodies manufactured according to the technology described above do not only feature unexpectedly high material quality, but an extraordinary degree of economic efficiency of the production is also achieved, because the central borehole already exits in the tubular rough material, with the processing time being short and the amount of cutting waste being low. It is very surprising that tubes made of corrosion-resistant, martensitic chromium steel can be made by means of extrusion such that a highly economical production of high quality hollow bodies is possible.

As contemplated according to this invention, the corrosion-resistant martensitic steel may be formed of an alloy containing, in percent by weight:

12 to 24 chromium (Cr)
0.02 to 5.9 molybdenum (Mo)
0.05 to 0.8 carbon (C)
0.05 to 0.8 nitrogen (N)
0.1 to 1.4 carbon plus nitrogen (C+N) and, optionally,
0.3 to 3.0 manganese (Mn)
0.01 to 3.0 nickel (Ni)
0.05 to 2.0 vanadium (V).

In this case, it is possible to achieve a particularly high material output and much lower processing expenditure, compared with prior art manufacturing processes.

Although there is lower cutting waste, it can be helpful in terms of production technology and increased quality in the area of the internal bore, if the tubes are made at hot forming temperatures by extruding a tube blank, with a drilling made by machining.

The economical manufacture of hollow bodies can be further increased if the tubes are made to dimension and/or calibrated by means of a further or subsequent forming treatment. It is thus possible to ensure only low amounts of cutting wastage, optionally by grinding the cylinder planes. Surprisingly, it was also found that the working zone thus created features a particularly high quality, apparently through a direct intervention effect of the shaping tools.

The invention is explained in greater detail by the following single exemplary embodiment.

A pressurized electroslag remelting block was made with the concentrations of the alloying elements indicated in Table 1. Table 1 also indicates the alloying contents of a comparison steel.

TABLE 1

| | C | Si | Mn | Cr | Mo | N | C + N |
|---|---|---|---|---|---|---|---|
| DESU[1] material | 0.32 | 0.6 | 0.3 | 15.0 | 1.0 | 0.4 | 0.72 |
| DIN[2] material no. 1.4125 | 1.05 | 0.4 | 0.4 | 17.0 | 0.5 | — | — |

[1]Druck-Elektro-Schlacke-Umschmelzblock (pressurized electroslag remelting block)
[2]Deutsches Institut für Normung, e.V. (German Institute for Standardization)

Round rods with a diameter of 200 mm and a length of 2 m were made out of a DESU material as well as a comparison steel and the initially employed material was taken as 100%.

The DESU rod was divided into four parts using axis-normal sawing. This was followed by drilling a hole with a diameter of 46 mm in each. After heating to forging temperature, the tube blank was extruded into a tube with an outside diameter of 69 mm and an inside diameter of 45 mm (resulting in a deformation ratio of about 13.8), whereby 25.5 m of useable raw material was produced with a cross-section close to the final dimensions for the manufacture of hollow bodies.

The comparison steel rod (DIN material no. 1.4125) was milled in a steel mill into a round rod with a diameter of 70 mm, resulting in 15 m of useable round material, which was machined by deep-hole drilling to provide a borehole with a diameter of 45 mm.

The yield of round rod material from tube rough material for manufacturing hollow bodies was found to be about 87% with the process according to this invention; whereas in the case of making a solid bar and drilling out the same, the result was found to be 51%.

The material tests of the nitrogenous martensitic steel according to the invention shown in Table 1 yielded an isotropic, annealed fine structure particularly suitable for extrusion; whereas in the comparison material according to Table 1, eutectic carbides were found in the annealed state, which had an adverse effect on the hot working properties of the steel as well as, ultimately, on the use properties of the part in a heat-treated state.

It is noted that the foregoing example has been provided merely for the purpose of explanation and is in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A process for the manufacture of a cylindrical hollow body with circular cross-section from solid rough material of corrosion-resistant, martensitic chromium steel, comprising providing a remelting block of the chromium steel;

making a tube blank having an axial borehole from the remelting block;

shaping the tube blank into a tube at hot forming temperature by extrusion at a deformation ratio of at least 6; and cutting the hollow body from the tube;

wherein the steel comprises, in weight percent:

from 12 to 29 chromium (Cr);

from 0.02 to 5.9 molybdenum (Mo);

from 0.05 to 0.8 carbon (C);

from 0.15 to 0.8 nitrogen (N);

provided that the sum (C+N) is not higher than 1.4.

2. The process of claim 1 , wherein the remelting block is a pressurized electroslag remelting block.

3. The process of claim 1, wherein the remelting block is rod-shaped.

4. The process of claim 1, wherein the axial borehole is made after forming the tube blank.

5. The process of claim 4, wherein the axial borehole is provided by metal cutting drilling.

6. The process of claim 2, wherein the deformation ratio is at least 9.

7. The process of claim 3, wherein the deformation ratio is at least 12.

8. The process of claim 1, wherein before cutting the hollow body at least one dimension of the tube is changed.

9. The process of claim 1, wherein the steel further comprises, in weight percent, at least one of from 0.3 to 3.0 manganese (Mn);

from 0.01 to 3.0 nickel (Ni); and from 0.05 to 2.0 vanadium (V).

10. The process of claim 1, wherein the steel comprises up to 28.0 weight percent Cr.

11. The process of claim 10, wherein the steel comprises from 12.1 to 24 weight percent Cr.

12. The process of claim 1, wherein the steel comprises from 0.25 to 5.8 weight percent Mo.

13. The process of claim 11, wherein the steel comprises from 0.15 to 0.7 weight percent C.

14. The process of claim 11, wherein the steel comprises from 0.15 to 0.7 weight percent N.

15. The process of claim 9, wherein the sum (C+N) is from 0.31 to 1.1.

16. The process of claim 2, wherein the martensitic chromium steel comprises, in weight percent:

from 12.1 to 24 chromium (Cr);

from 0.25 to 5.8 molybdenum (Mo);

from 0.15 to 0.7 carbon (C);

from 0.15 to 0.7 nitrogen (N);

provided that the sum (C+N) is from 0.31 to 1.1.

17. The process of claim 16, wherein the steel further comprises, in weight percent:

from 0.3 to 3.0 manganese (Mn);

from 0.01 to 3.0 nickel (Ni); and from 0.05 to 2.0 vanadium (V).

18. The process of claim 1, wherein the steel further comprises from 0.1 to 2 weight percent silicon.

19. The process of claim 1, wherein the process comprises:

providing a pressurized electroslag remelting block of the martensitic chromium steel;

making a tube blank from the remelting block and providing the tube blank with a central borehole;

shaping the tube blank into a tube at hot forming temperature by extrusion at a deformation ratio of at least 9; and dividing the tube into hollow bodies by cutting perpendicularly to the longitudinal axis of the tube;

wherein the martensitic chromium steel comprises as essential elements, besides iron, in weight percent:

from 12.1 to 24 chromium (Cr);

from 0.25 to 5.8 molybdenum (Mo);

from 0.15 to 0.7 carbon (C);

from 0.15 to 0.7 nitrogen (N);

provided that the sum (C+N) is from 0.31 to 1.1.

20. The process of claim 19, wherein the steel further comprises, in weight percent:

up to 3.0 manganese (Mn);

up to 3.0 nickel (Ni); and up to 2.0 vanadium (V).

21. A process for the manufacture of a cylindrical hollow body with circular cross-section from solid rough material of corrosion-resistant, martensitic chromium steel, comprising providing a remelting block of the chromium steel;

making a tube blank having an axial borehole from the remelting block;

shaping the tube blank into a tube at hot forming temperature by extrusion at a deformation ratio of at least 6; and cutting the hollow body from the tube;

wherein the cylindrical hollow body is selected from circular shear blades, roller bearing rings, ball-bearing races and ring bodies for axial drives and ball spindles.

* * * * *